United States Patent [19]

Strongwater

[11] Patent Number: 4,683,592

[45] Date of Patent: Aug. 4, 1987

[54] COMBINATION ICE SCRAPER AND MITT

[76] Inventor: Murray Strongwater, 326 Hewlett Neck Rd., Woodmere, N.Y. 11598

[21] Appl. No.: 873,421

[22] Filed: Jun. 12, 1986

[51] Int. Cl.[4] ..... A41D 13/08

[52] U.S. Cl. ..... 2/17; 2/16; 2/158; 2/160; 2/DIG. 6; 15/236 R; 15/227

[58] Field of Search ..... 2/17, 160, 16, 158, 2/160, DIG. 6; 15/227, 236 R

[56] References Cited

U.S. PATENT DOCUMENTS

| | | | |
|---|---|---|---|
| 353,861 | 12/1886 | Hull | 2/17 |
| 2,831,206 | 4/1958 | Curtis | 15/227 X |
| 3,116,502 | 1/1964 | Gerber | 15/227 X |
| 3,532,344 | 10/1970 | Masstab | 2/160 X |
| 4,164,801 | 8/1979 | Thomas | 15/236 R |
| 4,414,692 | 11/1983 | Dzierson et al. | 2/160 |
| 4,504,980 | 3/1985 | Butcher | 2/160 |
| 4,538,320 | 9/1985 | Batt | 2/160 X |

FOREIGN PATENT DOCUMENTS

| | | | |
|---|---|---|---|
| 48875 | 1/1931 | Norway | 2/17 |

*Primary Examiner*—Stephen Marcus
*Assistant Examiner*—T. Graveline
*Attorney, Agent, or Firm*—Henry R. Lerner

[57] ABSTRACT

A combination ice scraper and mitt includes an ice scraper formed by an elongated member having a handgrip section and an opposite scraping end with a beveled scraping edge, the elongated member tapering down in width from the scraping end toward the handgrip section; a hook engaging material secured to the ice scraper; a mitt positioned about the handgrip section, the mitt including a first end having an opening to permit insertion of a hand of a user, a second end having an opening for insertion of the handgrip section of the ice scraper, and an inner lining made of a thermal insulating material, to provide warmth to the hand of the user; a hook engageable material secured to the lining inside the mitt, immediately inwardly of the opening in the second end of the mitt, for engagement with the hook engaging material secured to the ice scraper so as to removably secure the ice scraper to the mitt; and an elastic band secured to the mitt in surrounding relation to the opening in the second end for causing the mitt to hug the scraper at the opening in the second end to substantially prevent cold air, snow and ice from entering the mitt and to provide increased securement of the mitt to the ice scraper.

7 Claims, 4 Drawing Figures

COMBINATION ICE SCRAPER AND MITT

BACKGROUND OF THE INVENTION

The present invention relates generally to an ice scraper and, more particularly, is directed to a combination ice scraper and mitt.

Hand held plastic scrapers for scraping ice and snow from the windshield of an automotive vehicle are well known. Generally, such scrapers are formed with a widened forward end having a beveled edge used for scraping, and an opposite, reduced width end which constitutes a handle for grasping the scraper. In use, the user grasps the handle and scrapes the ice and snow from the windshield with the beveled edge.

If the user does not wear any glove or mitt on the scraping hand, however, this hand becomes exposed to the cold air, snow and ice, resulting in discomfort during use. Even when a glove or mitt is used, the glove or mitt often becomes wet with use of the scraper, by reason of the snow and ice, again resulting in discomfort to the user.

In order to overcome such disadvantages, it has been proposed in U.S. Pat. No. 3,116,502 to provide a combination scraper with hand protecting means. Specifically, two elongate plate members of a rigid plastic material are secured together in face-to-face relation, one plate member having a tapered scraping edge at one end and the other plate member having a squeegee member at one end. At the opposite ends, the plate members open to form a hollow formation which houses a mitt that substantially conforms to the interior configuration of the hollow formation. The hollow formation thereby protects the hand and the mitt therein against snow and ice.

Because of difficulties in grasping the scraper of the aforementioned U.S. patent, and because of difficulties in washing, repair and/or removal of the mitt from the hollow formation, a combination scraper and mitt of a simpler construction has been proposed in U.S. Pat. No. 4,538,320. The scraper of this U.S. patent is formed from two telescoping plastic parts. A first part of a tapering configuration has a narrow end and an opposite, wider end with a beveled edge which constitutes a scraper blade. The other, second part is also of a tapering configuration and defines a handgrip at one end and has an opening at the opposite end for telescopically receiving the narrow end of the first part.

The mitt is positioned about the scraper and is secured in position thereon so as to leave the scraper blade exposed. Specifically, the mitt contains a slit at one end for receiving the first part. The dimensions of the slit are smaller than those of the open end of the second part. Accordingly, when the mitt is placed over the second part, the shoulder at the open end thereof is in engagement with the closed end of the mitt so that, when the first part of the scraper is thrust through the slit into the opening in the second part, the taper of the second part forces the material marginally of the slit into engagement with the shoulder, thus anchoring the mitt to the assembled parts of the scraper.

In an alternative embodiment, the first part is provided on its opposite faces with circular recesses and the second part is provided with buttons for interengagement with the recesses. During assembly, the material of the mitt, marginally of the slit, is folded inwardly into the open end of the second part and anchored between the recesses and buttons.

The advantage of this device is that the scraper can be readily removed from the mitt by disengaging the first part from the second part. However, because of this two-piece formation, the construction is relatively complicated for a simple device of a scraper. Also, the cost of the device, and the assembly thereof, is greatly increased. There is also the possibility that, during use, the first and second parts may become disengaged from each other, particularly when scraping very hard ice from a windshield, thereby requiring the user to remove the mitt and expose his hands to cold weather to reattach the parts. This is particularly the case in the alternative embodiment in which the material of the mitt trapped between the buttons and recesses has a tendency to normally bias the buttons outwardly, as shown in FIG. 7 of the U.S. patent.

It is also known to provide gloves or mittens having an opening therein which may be closed by means of "Velcro" covered flap portions, such as disclosed in U.S. Pat. Nos. 3,299,441; 4,383,336; and 4,543,671. U.S. Pat. Nos. 3,368,811; 3,508,280; 3,885,249; and 4,414,692 relate to gloves having "Velcro" strips over the outer surfaces thereof adapted to mate with "Velcro" covered objects to produce a gripping arrangement. For other "Velcro" securements, see, for example, U.S. Pat. Nos. 3,128;514; 3,370,818; and 3,387,341.

OBJECTS AND SUMMARY OF THE INVENTION

Accordingly, it is an object of the present invention to provide a novel combination ice scraper and mitt.

More particularly, it is an object of the present invention to provide a combination ice scraper and mitt in which the ice scraper is securely held in the mitt, but can easily and readily be removed for cleaning and repair.

It is another object of the present invention to provide a combination ice scraper and mitt that protects the scraping hand of the user from cold and wetness during use.

It is still another object of the present invention to provide a combination ice scraper and mitt in which the scraper is held securely in the mitt by a "Velcro" attachment, and an elastic band in the mitt further ensures such securement and also forms a seal against entry by the cold air, ice and snow.

In accordance with an aspect of the present invention, a combination scraper and mitt includes an ice scraper including an elongated member having a handgrip section and an opposite scraping end; one of a hook engaging material and a hook engageable material secured to the ice scraper; a mitt positioned about the handgrip section, the mitt including a first end having an opening to permit insertion of a hand of a user, and a second end having an opening for insertion of the handgrip section of the ice scraper; and the other of the hook engaging material and hook engageable material provided inside the mitt for engagement with the material secured to the ice scraper so as to removably secure the ice scraper to the mitt.

In accordance with still another aspect of the present invention, a combination ice scraper and mitt includes an ice scraper including an elongated member having a handgrip section and an opposite scraping end; one of a hook engaging material and a hook engageable material secured to the ice scraper; a mitt positioned about the handgrip section, the mitt including a first end having an opening to permit insertion of a hand of a user, and a second end having an opening for insertion of the handgrip section of the ice scraper; the other of the hook engaging material and hook engageable material provided inside the mitt for engagement with the material secured to the ice scraper so as to removably secure the ice scraper to the mitt; and an elastic band secured to the mitt in surrounding relation to the opening in the second end for causing the mitt to hug the scraper at the opening in the second end to substantially prevent cold air, snow and ice from entering the mitt and to provide increased securement of the mitt to the ice scraper.

In accordance with yet another aspect of the present invention, a combination ice scraper and mitt includes an ice scraper formed by an elongated member having a handgrip section and an opposite scraping end with a beveled scraping edge, the elongated member tapering down in width from the scraping end toward the handgrip section; a hook engaging material secured to the ice scraper; a mitt positioned about the handgrip section, the mitt including a first end having an opening to permit insertion of a hand of a user, a second end having an opening for insertion of the handgrip section of the ice scraper, and an inner lining to provide warmth to the hand of the user; a hook engageable material secured to the lining inside the mitt, immediately inwardly of the opening in the second end of the mitt, for engagement with the hook engaging material secured to the ice scraper so as to removably secure the ice scraper to the mitt; and an elastic band secured to the mitt in surrounding relation to the opening in the second end for causing the mitt to hug the scraper at the opening in the second end to substantially prevent cold air, snow and ice from entering the mitt and to provide increased securement of the mitt to the ice scraper.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
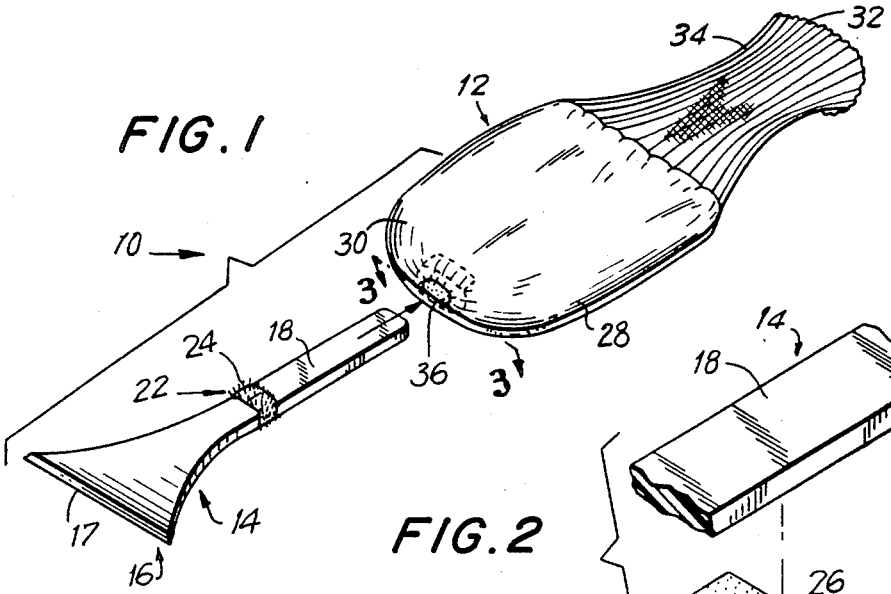
FIG. 1 is an exploded perspective view of a combination ice scraper and mitt according to the present invention.
Figure 2:
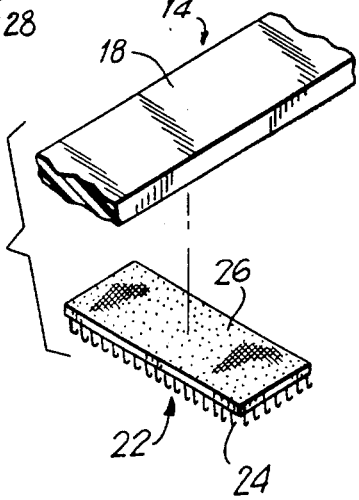
FIG. 2 is an exploded perspective view of a portion of the ice scraper of FIG. 1.

Referring to the drawings in detail, and initially to FIG. 1 thereof, a combination ice scraper and mitt 10 according to the present invention generally includes a mitt 12 and an ice scraper 14 removably secured thereto. As shown, scraper 14 is formed of a one-piece elongated piece of plastic, metal or the like, having a scraper end 16 with a beveled blade edge 17, which tapers down in width toward a substantially constant width handgrip section 18, as is conventional.

In accordance with the present invention, a hook engaging material 22 containing hook-like elements 24 on one surface thereof, and which is commonly sold under the trademark "Velcro", is secured about handgrip section 18 by an adhesive 26 or the like on the opposite surface of hook engaging material 22, such that hook-like elements 24 face outwardly for engaging a fabric in mitt 12, as will be described in greater detail hereinafter.

Mitt 12, as shown in FIG. 1, is preferably formed of a water repelling fabric 28 at its closed end 30, and has an opening 32 at its opposite end 34 to permit insertion of the hand of the user. The present invention, however, is not limited to the particular fabric enumerated herein. Also, mitt 12 is provided with a lining 35, preferably made of a thermal insulating material, for keeping the hand of the user warm during use.

Figure 3:
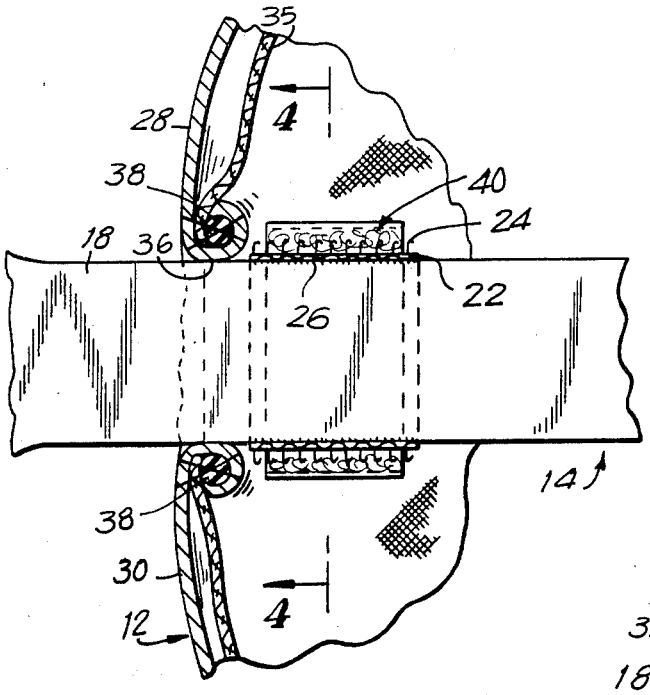
FIG. 3 is a horizontal cross-sectional view of the combination ice scraper and mitt of FIG. 1 in assembled condition, taken along line 3—3 thereof, between the upper layer of "Velcro" material and the upper surface of the ice scraper.

In accordance with the present invention, mitt 12 is provided with an opening 36 at its closed end 30, for receiving handgrip section 18 of scraper 14. An elastic band 38 is secured within mitt 12 and bounds opening 36, causing the material of mitt 12 bounding opening 36 to hug handgrip section 18 when the latter is inserted into mitt 12, as shown in FIG. 3. Elastic band 38 thereby provides a two-fold function, namely, to provide better securement of mitt 12 to scraper 14, and to substantially prevent cold air, ice and snow from entering mitt 12.

Figure 4:
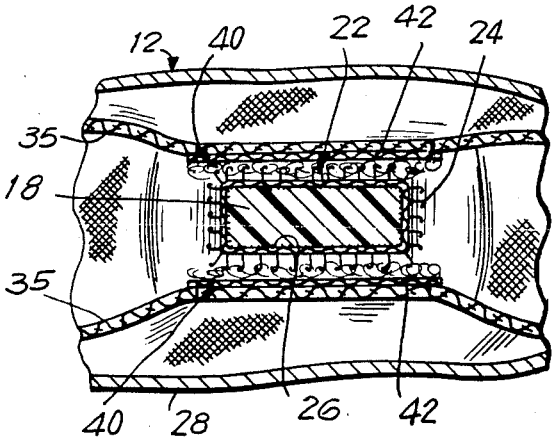
FIG. 4 is a cross-sectional view of the combination ice scraper and mitt of FIG. 3, taken along line 4—4 thereof.

The principal securement of scraper 14 to mitt 12, however, takes place by means of a hook-engageable material 40 secured to lining 35 immediately inwardly of elastic band 38. Hook-engageable material 40 is a fabric which contains threads and/or loops, also commonly sold under the trademark "Velcro", and which are engaged by hook-like elements 24 of hook-engaging material 22 secured to scraper 14, whereby scraper 14 is removably secured to mitt 12. Although it is preferable that hook-engageable material 40 completely surround scraper 14, it is only necessary that a sufficient area of hook-engageable material 40 be provided so as to ensure a secure attachment of scraper 14 to mitt 12. In this regard, as shown in FIGS. 3 and 4, it is only necessary to provide two strips 42 of hook-engageable material 40, which are secured to lining 35 in substantially parallel relation to opposite surfaces of handgrip section 18 of scraper 14.

Thus, with the present invention, a one-piece scraper 14 is provided which is removably secured to mitt 12 by means of a "Velcro" attachment. Further securement of scraper 14 within mitt 12 is achieved by means of elastic band 38 bounding opening 36 of mitt 12, thereby also substantially preventing the entry of cold air, ice and snow into mitt 12.

It will be appreciated that various modifications can be made to the present invention, within the scope of the claims. For example, hook-engageable material 40 could be secured about handgrip section 18 of scraper 14, whereby hook-engaging material 22 would be secured to lining 35 of mitt 12. Also, while hook-engageable material 40 has been described with respect to two strips 42 secured to lining 35 of mitt 12, hook-like elements 24 of hook engaging material 22 on scraper 14 could engage lining 35 itself if the latter is provided with loose threads of woven fabric.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined in the appended claims.

What is claimed is:

1. A combination ice scraper and mitt comprising:

a one-piece elongated member defining a handgrip at one end and a scraper at the opposite end;

one of a hook engaging material and a hook engageable material secured to the outer surface of said elongated member intermediate said ends;

a mitt having an inner surface, an outer surface, a first opening to permit insertion of a hand within the mitt and a second opening for insertion of said elongated member within said mitt, said mitt being provided on said inner surface thereof, inwardly of said second opening, with the other of said hook engaging material and hook engageable material, said material on the outer surface of said elongated member being in positive engagement with said material on the inner surface of said mitt inwardly of said second opening for securing said mitt to said elongated member.

2. A combination ice scraper and mitt as in claim 1, wherein said one of said hook engaging material and hook engageable material is secured to the outer surface of said elongated member by an adhesive.

3. A combination ice scraper and mitt as in claim 1, wherein said elongated member is made of plastic.

4. A combination ice scraper and mitt as in claim 1, wherein the inner surface of said mitt comprises an inner lining within said mitt made of a thermal insulating material to provide warmth to the hand, and the other of said hook engaging material and hook engageable material is secured to said lining immediately inwardly of said second opening of said mitt.

5. A combination ice scraper and mitt as in claim 1, wherein said hook engaging material is secured to the outer surface of said elongated member and said hook engageable material is secured to the inner surface of said mitt.

6. A combination ice scraper and mitt as in claim 1, wherein said material on the outer surface of said elongated member is separable from said material on the inner surface of said mitt whereby said mitt is disengageable from said elongated member.

7. A combination ice scraper and mitt as in claim 1, further comprising an elastic band, secured to said mitt in surrounding relation to said second opening to said mitt for causing said mitt to hug the outer surface of said elongated member at said second openingin said mitt to substantially prevent cold air, snow and ice from entering said mitt through said second opening and to provide increased securement of said mitt to the outer surface of said elongated member.

* * * * *